US005174729A

United States Patent [19]

Waters et al.

[11] Patent Number: 5,174,729

[45] Date of Patent: Dec. 29, 1992

[54] CONTROL SYSTEM FOR CONTROLLING SURGE AS A FUNCTION OF PRESSURE OSCILLATIONS AND METHOD

[75] Inventors: Peter D. Waters, San Diego, Calif.; John M. Champagne, Seattle, Wash.; John F. Defenbaugh, Rockford, Ill.

[73] Assignee: Sundstrand Corporation, Rockford, Ill.

[21] Appl. No.: 550,434

[22] Filed: Jul. 10, 1990

[51] Int. Cl.[5] ..... F04D 27/02

[52] U.S. Cl. ..... 417/310; 417/53

[58] Field of Search ..... 417/307, 310, 53; 73/753; 340/626

[56] References Cited

U.S. PATENT DOCUMENTS

| | | | |
|---|---|---|---|
| 2,969,805 | 1/1961 | Hunter | 137/189 |
| 4,003,370 | 1/1977 | Emil et al. | 73/753 |
| 4,156,578 | 5/1979 | Agar et al. | 415/1 |
| 4,177,649 | 12/1979 | Venema | 417/43 |
| 4,227,862 | 11/1980 | Andrew et al. | 417/18 |
| 4,581,900 | 4/1986 | Lowe et al. | 415/17 |
| 4,807,150 | 2/1989 | Hobbs | 364/510 |

OTHER PUBLICATIONS

"A New Technology in Energy-Efficient Electrically Driven Aircraft Environmental Control Systems" Authored by W. Cloud, J. McNamara and David B. Wigmore, presented at the 21st IECEC Conference, Aug. 25-29, 1986, Article #869390 American Chemical Society, pp. 1696-1702.

*Primary Examiner*—Michael Koczo
*Assistant Examiner*—David W. Scheuermann
*Attorney, Agent, or Firm*—Antonelli, Terry, Stout & Kraus

[57] ABSTRACT

A surge control (200) for a compressor (12) which produces a compressed gas in accordance with the invention includes a surge control valve (88) having a variable opening which is controlled by an electrical control signal which controls a flow rate of compressed gas flowing through a bypass line (84) between a point of higher pressure and a point of lower pressure in the compressor to control surge; a pressure transducer (120and 122), coupled to the compressor at a point of pressure higher than an inlet to the compressor, for producing an electrical signal representative of pressure; a filter (124), coupled to the pressure transducer, for filtering a selected frequency component of pressure fluctuations represented in the electrical signal to produce a filtered signal; and a controller (132), coupled to the filter, for producing the control signal as a function of the filtered signal.

26 Claims, 2 Drawing Sheets

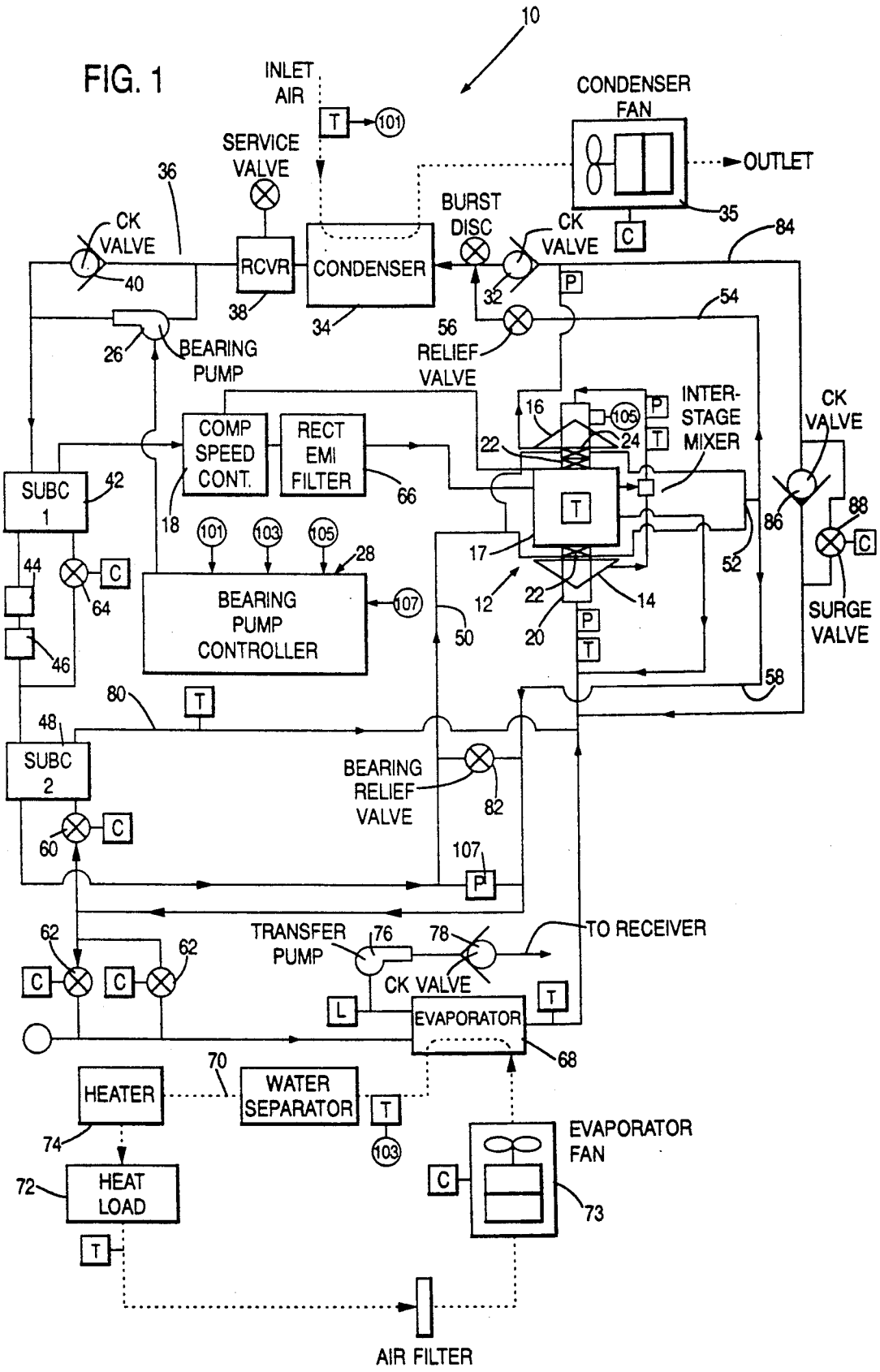
FIG. 1
10
INLET AIR
T
101
SERVICE VALVE
CONDENSER FAN
OUTLET
35
36
CK VALVE
40
RCVR
38
CONDENSER
34
BURST DISC
CK VALVE
C
84
32
P
54
56
RELIEF VALVE
26
BEARING PUMP
COMP SPEED CONT.
RECT EMI FILTER
66
16
105
P
T
INTER-STAGE MIXER
CK VALVE
22
24
SUBC 1
42
18
101
103
105
28
T
86
88
C
44
C
64
BEARING PUMP CONTROLLER
107
17
12
22
14
52
SURGE VALVE
50
20
P
T
46
58
80
T
48
SUBC 2
BEARING RELIEF VALVE
82
C
60
107
P
62
TRANSFER PUMP
76
78
TO RECEIVER
62
C
C
CK VALVE
L
T
EVAPORATOR
68
70
HEATER
WATER SEPARATOR
T
103
74
EVAPORATOR FAN
72
HEAT LOAD
C
73
T
AIR FILTER

CONTROL SYSTEM FOR CONTROLLING SURGE AS A FUNCTION OF PRESSURE OSCILLATIONS AND METHOD

CROSS-REFERENCE TO RELATED APPLICATIONS

Reference is made to patent application Ser. No. 550,544, entitled "Bearing Pump Control for Lubricating Hydrodynamic Compressor Bearings" filed on even date herewith which is assigned to the Assignee of the present invention, which application is incorporated by reference in its entirety; and to patent application Ser. No. 550,867, entitled "Superheat Sensor With Single Coupling To Fluid Line", filed on even date herewith, which is assigned to the Assignee of the present invention, which application is incorporated herein by reference in its entirety; and to patent application Ser. No. 550,433, entitled "Vapor Cycle Cooling System Having a Compressor Rotor Supported With Hydrodynamic Compressor Bearings", filed on even date herewith, which is assigned to the Assignee of the present application, which application is incorporated herein by reference in its entirety; and to patent application Ser. No. 550,506, entitled "Hydrodynamic Bearing Protection System and Method", filed on even date herewith, which is assigned to the Assignee of the present invention, which application is incorporated herein by reference in its entirety; and to patent application Ser. No. 550,458, entitled "Speed Control of a Variable Speed Aircraft Vapor Cycle Cooling System Condenser Fan and Compressor and Method of operation", filed on even date herewith, which is assigned to the Assignee of the present invention, which application is incorporated herein by reference in its entirety; and to Patent Application Ser. No. 550,432, entitled "Refrigeration System With Oiless Compressor Supported By Hydrodynamic Bearings With Multiple Operation Modes and Method of Operation", filed on even date herewith, which is assigned to the Assignee of the present invention, which application is incorporated herein by reference in its entirety; and to patent application Ser. No. 550,631, entitled "Vapor Cycle System Evaporator Control", filed on even date herewith, which is assigned to the Assignee of the present invention, which application is incorporated herein by reference in its entirety.

TECHNICAL FIELD

The present invention relates to surge control systems. More particularly, the present invention relates to surge control systems for centrifugal compressors having at least one compression stage.

BACKGROUND ART

Surge is a well-known condition which is to be avoided in the operation of compressors. An efficiently operated compressor is designed to be operated as close to the surge line as possible in order to obtain maximum efficiency. In a compressor, surge occurs when the volume of gas delivered to the inlet of the compressor falls below a predetermined limit. If the volume of gas is below the predetermined limit, the compressor will run out of gas to compress resulting in a reverse flow from the high pressure output to the low pressure input. Failure to reduce the resistance to the flow of gas through the compressor causes the surging cycle to repeat until a correct volume of gas flows through the compressor from the inlet to the outlet.

A conventional solution for controlling surge in a centrifugal compressor is to provide a bypass valve which couples compressed gas from the outlet back to the inlet which functions to provide sufficient mass flow of gas to the inlet to prevent the surging condition. Various control schemes exist for controlling the flow rate of gas through a surge control valve in a bypass line between a point of higher pressure in a compressor and a point of lower pressure to control surge.

U.S. Pat. No. 2,969,805 discloses a surge controller which uses pneumatic control of a relief valve to prevent surge. The pneumatic control is complex in structure, is not easily integrated into electronic control systems for valves which are in use today and does not have the reliability of electrical systems. The pneumatic control detects sudden positive or negative pressure variations on the output of the compressor as the control parameter for the relief valve. However, the '805 patent does not disclose a surge control for a multiple stage compressor and does not disclose detecting the amplitude of pressure variations at each stage of compression and controlling the relief valve with a largest amplitude pressure variation detected at all of the stages. The '805 patent does not disclose that any particular frequency range of pressure variation is optimal for controlling the relief valve.

U.S. Pat. No. 4,156,578 discloses the control of surge by complex electrical signal processing as a function of several variables of system operation. The complexity of this system is a disadvantage in applications such as an airframe vapor cycle cooling system.

U.S. Pat. No. 4,807,150 discloses a surge control which minimizes the recycling of compressed gas between an inlet and an outlet stage. The system utilizes electrical signal processing to incrementally close the control valve toward a fully closed position until the flow is close to the surge limit or until the actual deviation of the set point flow in the actual process flow exceeds a desired high limit for the deviation. This system is complex which makes it undesirable for applications as an airframe vapor cycle cooling system.

DISCLOSURE OF INVENTION

The present invention is a surge control for a compressor having at least one stage which controls surge by using electrical signal processing to control a surge control valve which controls a flow rate of compressed gas flowing through a bypass line between a point of higher pressure and a point of lower pressure in a compressor as a function of a selected frequency component of a pressure fluctuation at at least one point in the compressor having a pressure higher than the pressure at the inlet of the compressor and method of operation. The surge control valve is controlled by electrical signal processing which is a function of sensed pressure at one or more higher pressure points in the compressor which minimizes the number of sensors when compared to the '805 patent, simplifies the signal processing required to generate a control signal for controlling the surge control valve and provides higher reliability as a consequence of sensing only pressure and performing signal processing on only a signal representative of the pressure signal to control the surge control valve. A preferred application of the present invention is in an airframe vapor cycle cooling system.

A surge control for a compressor which produces a compressed gas in accordance with the invention includes a surge control valve having a variable opening which is controlled by an electrical control signal which controls a flow rate of compressed gas flowing through a bypass line between a point of higher pressure and a point of lower pressure in the compressor to control surge; a pressure transducer, coupled to the compressor at a point of pressure higher than an inlet to the compressor, for producing an electrical signal representative of the pressure; a filter, coupled to the pressure transducer for passing a selected frequency component representation of pressure fluctuations occurring during surge represented in the electrical signal to produce a filtered signal containing any of the selected frequency component sensed by the pressure transducer; and a controller, coupled to the filter, for producing the control signal as a function of the filtered signal. The filter passes a selected AC frequency range of electrical signals which may be from 1-10 Hz. and may be from 3-5 Hz. The invention further includes a summer, coupled to the filter and the controller, for producing an error signal, equal to a difference between the filtered signal and a reference signal representative of a noise level of pressure variation of the compressor which occurs when the compressor is operating just outside the surge region, which is an input signal of the controller. A rectifier is coupled to the filter and the controller for rectifying the selected frequency component which is coupled to the controller. The controller may be a proportional and integral controller which permits reducing the error signal to zero and the filter is a bandpass filter. A valve driver is coupled to the controller and the surge control valve for amplifying the control signal which is applied to the surge control valve.

A surge control for a multiple stage compressor which produces a compressed gas in accordance with the invention includes a surge control valve having a variable opening which is controlled by an electrical control signal which controls a flow rate of compressed gas flowing through a bypass line between a point of higher pressure and a point of lower pressure in the compressor to control surge; a plurality of pressure transducers each coupled to an output of a different stage of the compressor for producing an electrical signal representative of the pressure at the output of the stage; a plurality of filters, each filter coupled to a different pressure transducer for passing a selected frequency component representative of pressure fluctuations occurring during surge in the signal produced by the pressure transducer to which the filter is connected to produce a filtered signal containing any of the selected frequency component sensed by the pressure transducer; and a controller, coupled to the filters, for producing the control signal as a function of the filtered signals. The invention further includes a maximum signal detector, coupled to the filtered signals, for producing an output signal which is the filtered signal having the maximum amplitude of the filtered signals produced by the filters with the output signal being coupled to the controller. The filter passes a selected AC frequency range which may be between 1-10 Hz. and may be between 3-5 Hz. The invention further includes a summer, coupled to the maximum signal detector and to the controller, for producing an error signal, equal to a difference between the output signal which is filtered having the maximum amplitude of the filtered signals and a reference signal, that is a function of compressor noise occurring when the compressor is operating just outside the surge region which is an input signal of the controller. The invention further includes a rectifier, coupled to the maximum signal detector and the summer, for rectifying the selected frequency component which is an AC signal. The selected frequency component may be between 1-10 Hz. and may be between 3-5 Hz.

A method of controlling surge in a compressor having a surge control valve which controls a flow rate of compressed gas flowing through a bypass line between a point of higher pressure and a point of lower pressure in the compressor in accordance with the invention includes sensing of a pressure fluctuation at a point in the compressor having a pressure higher than pressure at the inlet to the compressor to produce an electrical signal representative of the pressure fluctuation; filtering the electrical signal to separate and pass a selected frequency component representative of of pressure fluctuations occurring during surge to provide an electrical signal containing any of the selected frequency component which has been sensed and controlling the bypass valve to vary the flow rate in the bypass line as a function of the electrical signal representative of the selected frequency component to control surge. The frequency component is AC, may be between 1-10 Hz. and may be between 3-5 Hz. The invention further includes rectifying the electrical signal containing any of the selected frequency component to produce a rectified signal; comparing the rectified signal to a reference signal which is a function of compressor noise occurring at a selected point outside a surge region of the compressor to generate an error signal; and controlling the valve to vary flow rate as a function of the error signal.

A method of controlling surge in a multiple stage compressor having a surge control valve which controls a flow rate of compressor gas flowing through a bypass line between a point of higher pressure and a point of lower pressure in the compressor in accordance with the invention includes sensing a selected frequency component of a plurality of pressure fluctuations respectively located at an outlet of different stages which occurs during surge representative of pressure fluctuations occurring during surge to produce electrical signals containing any of the pressure fluctuations which have been sensed at the different stages; and controlling the surge control valve to vary the flow rate in the bypass line as a function of the electrical signal containing any of the selected frequency component having a largest magnitude when compared to a magnitude of at least one other electrical signal representative of the selected frequency component to control surge. The frequency components are AC, may be between 1-10 Hz. and may be between 3-5 Hz. The invention further includes rectifying the electrical signal representative of the selected frequency component having the largest magnitude to produce a rectified signal; comparing the rectified signal to a reference signal which is a function of compressor noise occurring at a selected point outside a surge region of the compressor to generate an error signal; and controlling the valve to vary the flow rate as a function of the error signal.

BRIEF DESCRIPTION OF DRAWINGS

FIG. 1 illustrates a preferred application of a surge control system in accordance with the present invention.

BEST MODE FOR CARRYING OUT THE INVENTION

Figure 2:
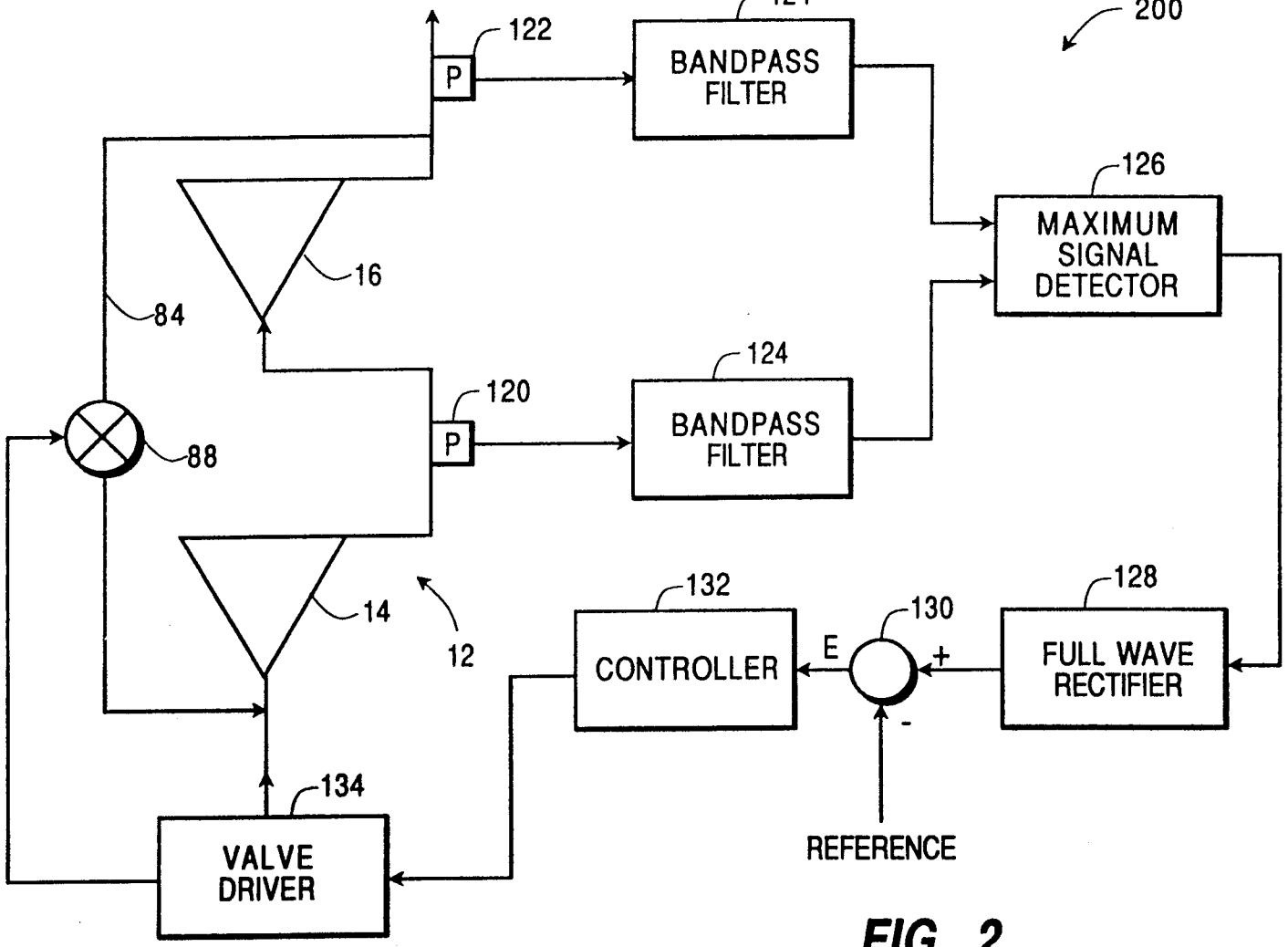
FIG. 2 illustrates a surge control system in accordance with the present invention.

FIG. 1 illustrates a vapor cycle cooling system for use in an airframe having a surge control system in accordance with the present invention. The system of FIG. 1 employs a non-azeotropic binary refrigeration fluid. A centrifugal compressor 12 is comprised of two compressor stages 14 and 16 which are driven by a high speed electrical motor rotating at a rotational velocity of up to 70,000 rpm. The motor 17 is driven by a speed control 18 of the type described in U.S. patent application Ser. Nos. 319,719, 319,727, and 320,224, which are assigned to the Assignee of the present invention. The rotor 20 on which the compressor stages 14 and 16 are mounted is supported by a pair of hydrodynamic radial bearings 22 and a hydrodynamic thrust bearing 24. The hydrodynamic radial and thrust bearings 22 and 24 are maintained by pressurized oiless liquid state refrigerant which is provided from the second stage 16 of the compressor 12 and from a bearing pump 26 which is activated by a bearing pump controller in accordance with predetermined conditions of operation of the refrigeration system which are based upon sensed operational parameters as disclosed in application Ser. No. 550,544 entitled "Bearing Pump Control For Lubricating Hydrodynamic Compressor Bearings", filed on even date herewith. The function of the bearing pump 26 is to make-up for a deficiency in the pressure and quantity of oil outputted from the second stage 16 of the compressor 12 which is necessary to maintain the hydrodynamic radial and thrust bearings 22 and 24 during predetermined operational conditions of the refrigeration system. The bearing pump 26 outputs the pressurized refrigerant at a pressure higher than the output pressure of the second stage 16 of the compressor when the bearing pump is activated by the bearing pump controller 28 as described in the above-referenced patent application. The bearing pump 26 may also be the only source of pressurized refrigerant for the evaporator 68 under certain economy conditions as disclosed in Ser. No. 550,432.

The flow of refrigerant through the refrigeration system 10 is described as follows. Pressure and temperature transducers which are located at various points in the system, are identified by a square box respectively containing the letters "P" and "T". Control signals applied to controllable expansion valves, which are provided from a system controller (not illustrated), are identified by a square box labelled with the letter "C". A square box containing the letter "L" is a liquid level sensor providing a signal to the aforementioned system controller (not illustrated). The connections of the liquid level sensor and pressure and temperature transducers to the system controller (not illustrated) have been omitted. Pressurized refrigerant flows from the second stage 16 of the compressor through check valve 32 to condenser 34 which the pressurized refrigerant gas is condensed to liquid. A first heat exchange fluid, which in this application is air, flows in a counterflow direction through the condenser 34 under suction created by condenser fan 35 to remove heat from the refrigerant and cause the refrigerant to condense to liquid. The refrigerant is outputted by the condenser 34 to refrigerant circuit 36 which couples the condenser to the radial and thrust hydrodynamic bearings 22 and 24 through a flow path including receiver 38, check valve 40, a first subcooler 42, filter dryer 44, sight glass 46, a second subcooler 48 and from the output of the second subcooler 48 through line 50 to the input of the radial and thrust hydrodynamic bearings 22 and 24. The liquid refrigerant discharged from the radial and hydrodynamic bearings 22 and 24 is combined at point 52. The liquid refrigerant flows from point 52 in a first path 54 when relief valve 56 is opened to the input of the condenser 34 and through a second path 58 back to the expansion valve 60 and, while the invention is not limited thereto, to a pair of parallel connected expansion valves 62. The relief valve 56 is opened when the valves 60 and 62 are closed.

The subcooler 42 functions to cool liquid refrigerant outputted by the receiver 38 to a temperature determined by expansion valve 64 which controls the superheat at the inlet of the second stage of the compressor 12. The expanded refrigerant outputted by the expansion valve 64 cools the liquid refrigerant flowing into the subcooler 42. The two phase refrigerant flowing from the subcooler 42 cools the electronics contained in the compressor speed control 18 and the electronics contained in the rectifier and EMI filter 66 which are components used for driving the electric motor 17.

The expansion valves 60 and 62 perform different functions. The expansion valve 60 controls the superheat at the output of the subcooler 48. The expansion valves 62 perform one of two functions. The first function is the controlling of the superheat out of the evaporator 68 which cools air flowing in a direction counter to the flow of refrigerant through the evaporator in a airflow path 70 which cools an avionics heat load 72. The second function is the control of the air temperature out of the evaporator. Only one function may be performed at a time. Fan 73 provides the pressure head to cause air to circulate in the airflow path 70. Optionally, a heater 74 which may have multiple stages but is not limited thereto, may be provided in the airpath 70 when cooling of the heat load 72 which may be avionics is not necessary. The evaporator 68 is coupled to the receiver through a transfer pump 76 and a check valve 78.

A function of the second subcooler 48 is to lower the temperature of liquid refrigerant flowing out of the first subcooler 42 to a temperature at which the refrigerant will maintain a liquid state flowing through the hydrodynamic radial and thrust bearings 22 and 24 after absorbing heat therein. The cold side output 80 from the second subcooler 48 combines with the refrigerant flow to the first stage 14 of the compressor 12. The output from the evaporator 68 also supplies the input to the first stage 14 of the compressor.

A bearing relief valve 82 bypasses the hydrodynamic radial and thrust bearings 22 and 24 when the pressure across the bearings reaches a predetermined maximum pressure, such as 50 psi, to avoid dropping excessive pressure across the hydrodynamic radial and thrust bearings 22 and 24 which may damage the bearings. A $\Delta P$ pressure transducer 107 senses when the pressure drop across the radial and thrust bearings 22 and 24 is less than 18 psi.

The output from the second stage 16 of the compressor also flows through a fluid circuit 84 which contains a parallel connection of a check valve 86 and a surge control valve 88. The surge control valve 88 is controlled in accordance with the present invention to provide recirculation of refrigerant from the output stage 16 back to the input stage 14 of the compressor 12 during surge conditions as a function of a selected frequency component of a pressure fluctuation at at least one point in the compressor having a pressure higher than pressure at the inlet to the compressor. Pressure transducers 120 and 122 respectively monitor the pressure of the refrigerant in the two-stage compressor 12 between the two stages of the compressor 14 and 16 and at the output of the second stage respectively. The control of the opening of the surge control valve 88 in accordance with signal processing of the pressure signals produced by the pressure transducers 120 and 122 to eliminate surge is described below with respect to FIG. 2.

FIG. 2 illustrates a surge control system 200 in accordance with the present invention. Like reference numerals identify like parts in FIGS. 1 and 2. While the invention as illustrated in FIGS. 1 and 2 is for controlling surge in a multiple stage compressor, it should be understood that the present invention may be practiced with a single stage compressor in which pressure fluctuations which are sensed at the output of the compressor are bandpass filtered with the bandpass being for passing an AC signal having a selected low frequency range representative of the pressure fluctuations which occur during surge conditions. It should be noted that the low frequency range varies depending upon system design including compressor geometry. The magnitude and frequency of the low frequency component, which in the system illustrated in FIG. 1 may be between 1-10 Hz. and may be between 3-5 Hz., increases in frequency within the low frequency range as the severity of surge increases. By monitoring an electrical pressure signal representative of the above-referenced frequency component at one or more high pressure stages in a compressor and comparing it to a threshold noise level which is representative of the maximum noise level produced by the compressor in the low frequency pressure range characterizing the onset of surge, the opening of the surge control valve 88 is controlled as a function of the increase in amplitude of the rectified at least one frequency component of the pressure fluctuation which exceeds the magnitude of the reference signal to feedback compressed gas from the outlet to the inlet to drive operation of the compressor out of the surge region.

The signal processing of the output signals from the pressure transducers 120 and 122 in controlling the opening of the bypass valve 82 is described as follows. The output signal from each pressure transducer (with it being understood that the number of pressure transducers is equal to the number of stages of compression) is applied to bandpass filter 124 which passes AC within a frequency range which may be 1-10 Hz. for the system illustrated in FIG. 1 with 3-5 Hz. being preferable. The amplitude of the filtered electrical signals representative of pressure fluctuations within the low frequency pressure fluctuation range characterizing surge, which are sensed at the outlet of the stages or the outlet of the compressor, which exceeds a reference signal having a magnitude representative of pressure fluctuations in the low frequency range in the compressor system at the onset of surge is used to control the opening of the expansion valve 88 to dynamically control the compressor to avoid surge operation. When multiple stages of compression are present in the compressor, as illustrated in FIG. 2, the electrical output signals from the bandpass filters 124 are applied to a maximum signal detector 126 which passes the electrical signal from the bandpass filter 124 having a largest magnitude when compared to a magnitude of at least one other selected frequency component outputted by at least one other bandpass filter 124. The invention may be applied to compressors having any number of stages with the maximum signal detector 126 being used for applications where multiple stages of compression are present. The maximum amplitude AC signal outputted by the maximum signal detector 126 is fullwave rectified by fullwave rectifier 128. The output of fullwave rectifier 128 is applied to summer 130 which produces an output error signal E which is equal to the difference between the output signal of the fullwave rectifier and a reference signal which is equal to the magnitude of the rectified component of pressure fluctuations within the aforementioned frequency range which occurs just outside the surge region of operation of the compressor. The error signal E is applied to a controller 132 which is preferably a PI controller of conventional design. The PI controller 132 has the advantage of driving the error signal E to zero which may not be obtained with a conventional proportional controller. The output of the controller 132 is applied to valve driver 134 which amplifies the output signal from the controller 132 to an amplitude sufficient for driving the bypass valve 88 which may be of conventional construction.

A method of controlling surge in the compressor 12 having stages 14 and 16 having a surge control valve 88 which controls a flow rate of compressed gas flowing through a bypass line 84 between the output of the compressor and the input of the compressor comprises sensing a selected low frequency component, which is AC representative of pressure fluctuations that characterizes the occurrence of surge in the compressor, that may be from 1-10 Hz. and may be between 3-5 Hz. for the system of FIG. 1 of pressure fluctuations respectively occurring at different stages 14 and 16, to produce electrical signals representative of the pressure fluctuations at the different stages, and controlling the surge control valve 88 to vary flow rate in the bypass line as a function of the electrical signals representative of the low selected frequency component having the largest magnitude passed by the bandpass filters 124 by the maximum signal detector 126 when compared to the magnitude of the frequency component passed by the remaining bandpass filters 124. The AC signal passed by bandpass filter 124 having a maximum amplitude as passed by a maximum signal detector 126 is fullwave rectified by a fullwave rectifier 128 to produce a rectified signal which is compared to the aforementioned reference to produce an error signal E to control the valve to vary the flow rate as a function of the error signal.

While a preferred application of the present invention is to multiple stage centrifugal compressors used in an airframe vapor cycle cooling system using a non-azeotropic binary refrigerant, it should be understood that the invention is not limited to multiple stage compressors, centrifugal compressors, non-azeotropic binary refrigerants, or airframe applications. Moreover, as stated above, the particular frequency range of pressure fluctuations which characterize surge in a compressor system varies with the design of the compressor including its geometry. With the invention, determination of the frequency range of pressure fluctuations which characterize surge in the system permits detection of an amplitude of pressure fluctuations in the range exceeding a noise threshold which characterizes the onset of surge to be used as a control variable for a surge control valve.

While the invention has been described in terms of its preferred embodiment, it should be understood that numerous modifications may be made thereto without departing from the spirit and scope of the invention as defined in the appended claims. It is intended that all such modifications fall within the scope of the appended claims.

We claim:

1. A surge control for a compressor which produces a compressed gas comprising:

a surge control valve having a variable opening which is controlled by an electrical control signal which controls a flow rate of compressed gas flowing through a bypass line between a point of higher pressure and a point of lower pressure in the compressor to control surge;

a pressure transducer, coupled to the compressor at a point of pressure higher than an inlet to the compressor, for producing an electrical signal representative of the pressure;

a filter, coupled to the pressure transducer, for passing a selected frequency component representative of pressure fluctuations occurring during surge in the electrical signal to produce a filtered signal containing any of the selected frequency component sensed by the pressure transducer;

a controller, coupled to the filter, for producing the control signal as a function of the filtered signal; and a summer, coupled to the filter and to the controller, for producing an error signal, equal to a difference between the filtered signal and a reference signal representative of a noise level of pressure variation of the compressor occurring at a selected point outside a surge region of the compressor, which is an input signal of the controller.

2. A surge control in accordance with claim 1 wherein:

the controller is a proportional and integral controller;

the filter is a bandpass filter which passes a selected frequency range between 1–10 Hz.; and further comprising;

a rectifier, coupled to the filter and the controller, for rectifying the filtered signal component which is coupled to the controller.

3. A surge control in accordance with claim 1 wherein:

the controller is a proportional and integral controller;

the filter is a bandpass filter which passes a selected frequency range between 1–10 Hz.; and further comprising a rectifier, coupled to the filter and the controller, for rectifying the filtered signal component which is coupled to the controller.

4. A surge control in accordance with claim 3 further comprising:

a valve driver, coupled to the controller and the surge control valve, for amplifying the control signal which is applied to the surge control valve.

5. A surge control in accordance with claim 3 further comprising:

a valve driver, coupled to the controller and the surge control valve, for amplifying the control signal which is applied to the surge control valve.

6. A surge control in accordance with claim 1 wherein:

the filter passes a selected AC frequency range.

7. A surge control in accordance with claim 6 further comprising:

a rectifier, coupled to the filter and the controller, for rectifying the filtered signal which is coupled to the controller.

8. A surge control in accordance with claim 6 wherein:

the selected frequency range is between 1–10 Hz.

9. A surge control in accordance with claim 8 wherein:

the selected frequency range is between 3–5 Hz.

10. A surge control in accordance with claim 8 further comprising:

a rectifier, coupled to the filter and the summer, for rectifying the filtered signal which is coupled to the summer.

11. A surge control for a multiple stage compressor which produces a compressed gas comprising:

a surge control valve having a variable opening which is controlled by an electrical control signal which controls a flow rate of compressed gas flowing through a bypass line between a point of higher pressure and a point of lower pressure in the compressor to control surge;

a plurality of pressure transducers each coupled to an output of a different stage of the compressor for producing an electrical signal representative of the pressure at the output of the stage;

a plurality of filters, each filter coupled to a different pressure transducer for passing a selected frequency component representative of pressure fluctuations occurring during surge in the signal produced by the pressure transducer to which the filter is connected to produce a filtered signal containing any of the selected frequency component sensed by the pressure transducer coupled to the filter;

a controller, coupled to the filters, for producing the control signal as a function of the filtered signals; and a maximum signal detector, coupled to the filtered signals, for producing an output signal which is the filtered signal having the maximum amplitude of the filtered signals produced by the filters with the output signal being coupled to the controller.

12. A surge control in accordance with claim 11 wherein:

the filter passes a selected AC frequency range.

13. A surge control in accordance with claim 12 wherein:

the selected frequency range is between 1–10 Hz.

14. A surge control in accordance with claim 12 wherein:

the selected frequency range is between 3–5 Hz.

15. A surge control in accordance with claim 11 further comprising:

a summer, coupled to the maximum signal detector and to the controller, for producing an error signal, equal to a difference between the output signal which is filtered having the maximum amplitude of the filtered signals and a reference signal representative of a noise level of pressure variation of the compressor occurring at a selected point outside a surge region of the compressor, which is an input signal of the controller.

16. A surge control in accordance with claim 15 wherein:

the selected frequency component is between 1-10 Hz.

17. A surge control in accordance with claim 15 further comprising:

a rectifier, coupled to the maximum signal detector and the summer, for rectifying the selected frequency component which is an AC signal.

18. A surge control in accordance with claim 17 wherein:

the selected frequency component is between 3-5 Hz.

19. A method of controlling surge in a compressor having a surge control valve which controls a flow rate of compressed gas flowing through a bypass line between a point of higher pressure and a point of lower pressure in the compressor comprising:

sensing a pressure fluctuation at a point in the compressor having a pressure higher than pressure at an inlet to the compressor to produce an electrical signal representative of the pressure fluctuation;

filtering the electrical signal to separate and pass a selected frequency component representative of pressure fluctuations occurring during surge to produce an electrical signal containing any of the selected frequency component which has been sensed;

rectifying the electrical signal containing any of the selected frequency component to produce a rectified signal;

comparing the rectified signal to a reference signal which is a function of compressor noise occurring at a selected point outside a surge region of the compressor to generate an error signal; and controlling the valve to vary flow rate as a function of the error signal.

20. A method in accordance with claim 19 wherein: the frequency component is between 1-10 Hz.

21. A method in accordance with claim 19 wherein: the frequency component is AC.

22. A method in accordance with claim 21 wherein: the frequency component is between 3-5 Hz.

23. A method of controlling surge in a multiple stage compressor having a surge control valve which controls a flow rate of compressed gas flowing through a bypass line between a point of higher pressure and a point of lower pressure in the compressor comprising:

sensing a selected frequency component of a plurality of pressure fluctuations respectively located at an outlet of different stages representative of pressure fluctuations occurring during surge to produce electrical signals containing any of the pressure fluctuations which have been sensed at the different stages with the frequency component being between 1-10 Hz.;

rectifying the electrical signal containing any of the selected frequency component having a largest magnitude to produce a rectified signal;

comparing the rectified signal to a reference signal which is a function of compressor noise occurring at a selected point outside a surge region of the compressor to generate an error signal; and controlling the valve to vary the flow rate as a function of the error signal.

24. A method in accordance with claim 23 wherein: the frequency components are between 1-10 Hz.

25. A method in accordance with claim 24 wherein: the frequency of components are between 1-10 Hz.

26. A method in accordance with claim 25 wherein: the frequency components are between 3-5 Hz.

* * * * *